US006256953B1

(12) United States Patent
Vulin

(10) Patent No.: US 6,256,953 B1
(45) **Date of Patent: *Jul. 10, 2001**

(54) FINISHING DEVICE FOR MOUNTING COVERING PANELS ON WALLS OR CEILINGS

(75) Inventor: Michel Vulin, Oyonnax (FR)

(73) Assignee: Grosfillex S.A.R.L., Oyonnax (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 5 days.

(21) Appl. No.: 09/259,359

(22) Filed: Feb. 26, 1999

(30) Foreign Application Priority Data

Mar. 2, 1998 (FR) ..... 98 02468

(51) Int. Cl.[7] ..... E04B 2/88

(52) U.S. Cl. ..... 52/281; 52/282.1; 52/311.1; 52/312

(58) Field of Search ..... 52/281, 282.1, 52/282.2, 311.1, 312

(56) References Cited

U.S. PATENT DOCUMENTS

| | | | | |
|---|---|---|---|---|
| 1,129,658 | * | 2/1915 | Foy | 52/282.1 X |
| 1,234,903 | * | 7/1917 | Jester | 52/281 X |
| 2,126,499 | * | 8/1938 | Petersen | 52/282.1 X |
| 2,316,035 | * | 4/1943 | Westrope | 52/312 |
| 2,379,179 | * | 6/1945 | Petersen | 52/282.1 |
| 3,635,787 | | 1/1972 | Shanok et al. . | |
| 4,028,856 | * | 6/1977 | Dalbec | 52/281 |
| 5,241,798 | * | 9/1993 | Platt et al. | 52/311.2 |
| 5,444,953 | * | 8/1995 | Koening et al. | 52/282.1 |
| 5,459,969 | | 10/1995 | Stibolt et al. . | |

FOREIGN PATENT DOCUMENTS

| | | |
|---|---|---|
| 28 04 173 | 8/1979 | (DE) . |
| 2 700 568 | 7/1994 | (FR) . |
| 960065 | 6/1964 | (GB) . |

* cited by examiner

*Primary Examiner*—Carl D. Friedman
*Assistant Examiner*—Phi Dieu Tran A
(74) *Attorney, Agent, or Firm*—Wolf, Greenfield & Sacks, P.C.

(57) ABSTRACT

A finishing device or "molding" comprises at least one support strip designed to be fixed on a support structure, a visible strip, and at least one spacer flank holding the visible strip at a distance from the support strip. The spacer flank is connected to the visible strip by a link strip which extends parallel to the first side portion with which it forms a first fold. The free margin of the second side portion is fitted with a closure element comprising a closure strip which forms a second fold together with said second side portion. The visible strip of the molding is made of extruded transparent plastics material, and the device is suitable for containing a decorative insert in the form of a strip suitable for being placed against the inside face of the visible strip and of being held in place by the two above-mentioned folds.

15 Claims, 3 Drawing Sheets

FIG.4
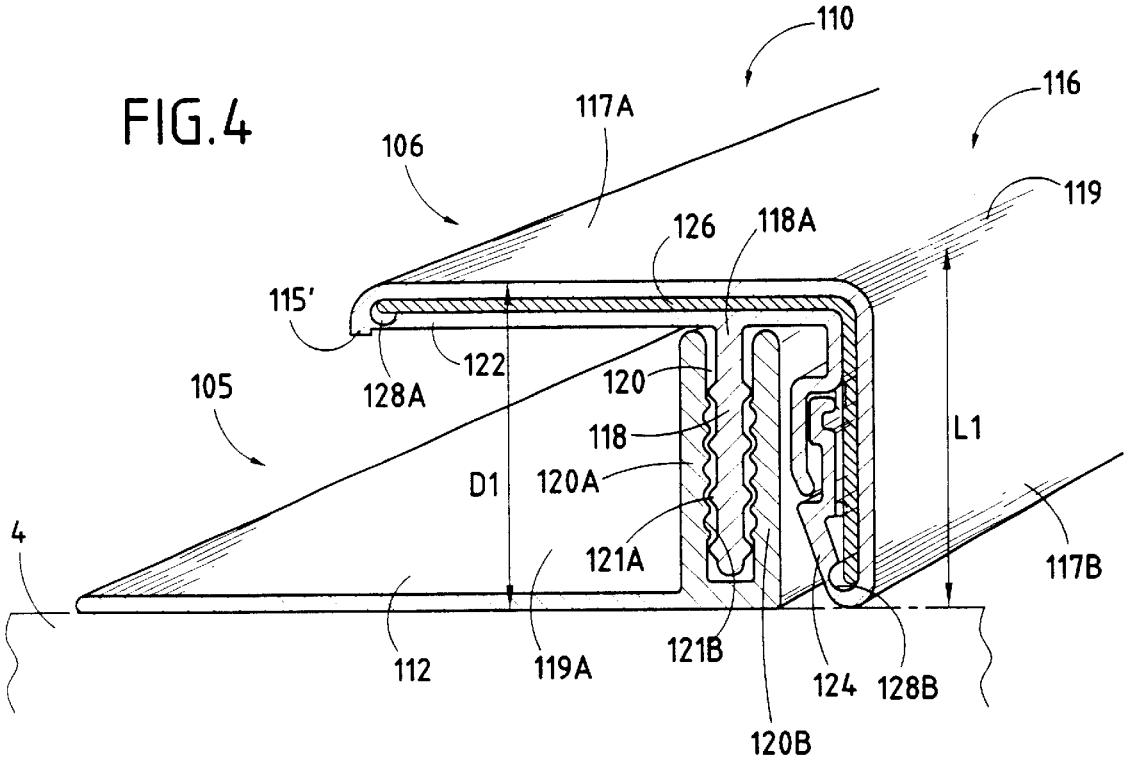
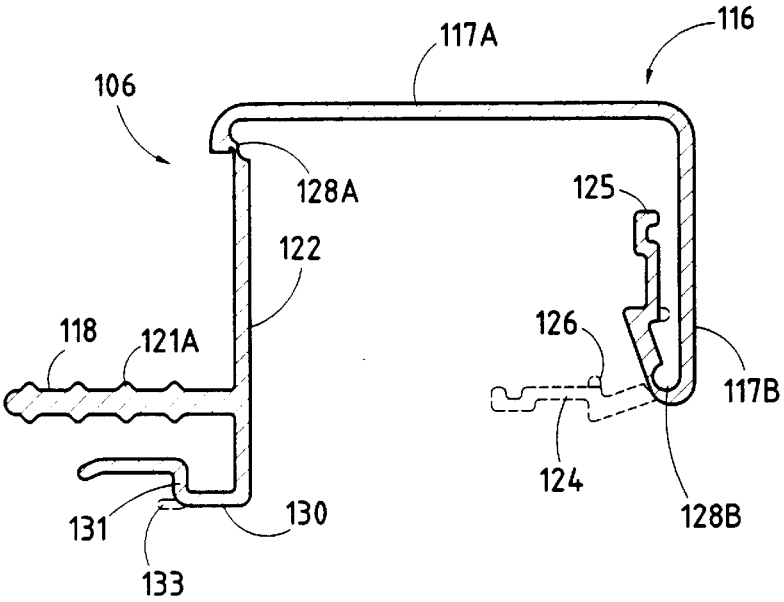
FIG.5

FINISHING DEVICE FOR MOUNTING COVERING PANELS ON WALLS OR CEILINGS

The present invention relates to a finishing profile device or "molding" comprising at least a first support strip designed to be fixed on a support structure, and a "visible" strip designed to be visible when the molding is in place on said support structure. Said visible strip comprises first and second side portions of strip shape, at least the first side portion extending over the first support strip being held spaced apart therefrom by first spacer means once the molding has been put into place on said support structure so as to define at least a first side housing suitable for receiving the side margin of an element such as a panel for covering the support structure.

BACKGROUND OF THE INVENTION

A finishing device of that type is known from the French patent published in the name of the Applicant under the No. 2 700 568. The support structure on which the molding is to be fixed can be a wall or a ceiling, for example. For covering this type of structure, it is known to use covering panels, e.g. made of flat shaped pieces that are assembled to one another by means of a tongue and groove system. The finishing device serves to provide the transition between panels, in particular along edges or in corners formed by the support structure.

The above-specified French patent proposes a device which in fact comprises three molding structures: two support moldings and one covering molding. The support moldings are fixed to the structure, while the covering molding is designed to cover the support moldings while holding captive the edge corresponding to at least one covering panel. The molding device can be disposed so as to present a plane surface or a surface shaped to have a concave angle or a convex angle. The device disclosed in French patent No. 2 700 568 gives satisfaction, but it suffers from the drawback of leaving its user with no freedom in selecting the decoration of the visible strip.

Naturally, the manufacturer can propose in its range of products finishing moldings that are of different colors or, more generally, that are of different appearances, in general with matching covering panels also being proposed. Nevertheless, the user may desire to use the molding to obtain an appearance effect that is set off from that of the covering panel, e.g. to make a contrasting cornice or a finishing frieze of a color that contrasts with that of the covering panels.

OBJECTS AND SUMMARY OF THE INVENTION

An object of the present invention is to provide an improved finishing molding which, while remaining simple from the points of view of manufacture and laying on a support, provides the user with a much wider range of options concerning the final appearance that can be obtained by putting the molding into place.

According to the invention:

at least the visible strip is made of transparent plastics material;

the first spacer means comprise a first spacer flank which extends substantially perpendicularly relative to said first side portion in a region of the device which is situated between said side portion and the first support strip;

the device has a first link strip and a closure element, said first link strip extending between the free margin of the first side portion of the visible strip and the margin of the first spacer flank which is adjacent to said first side portion, while the closure element has a strip which is connected to the free margin of the second side portion of the visible strip;

once the device has been put into place on the support structure, the first side portion and the first link strip form two substantially parallel portions of a first fold extending over the first support strip, while the second side portion and the strip of the closure element form two substantially parallel portions of a second fold;

the device has a housing for decoration formed beneath the visible face and extending over substantially the entire width thereof between the first and second folds, said housing for decoration being suitable for containing a decorative insert in the form of a strip such that the side margin portions of said insert are respectively inserted in the first and second folds; and the first and second folds form respective first and second holding means suitable for holding said side margin portions of such a decorative insert in place.

It will be understood that the molding of the invention and of the above structure makes it possible to achieve the above-specified object. For a given application, the manufacturer can propose a single range of finishing moldings, leaving the user free to choose any type of decorative insert to achieve a desired visual effect. While being of a structure that is simple to manufacture, the molding is suitable for containing and holding a decorative insert in the form of strip such that the insert is visible at the visible face since this face, at least, is transparent. Insofar as the first link strip and the strip of the closure element extend beneath the visible strip, the housing for decoration is closed once the device has been put into place on the support structure (the ends of the device are closed, for example, respectively by the floor and by the ceiling when the molding is put into place vertically on a wall). The decorative insert can thus be removed only if the device itself is removed from the support structure, and that prevents any unwanted handling, e.g. by a child. The particular construction of the device (in particular the presence and the disposition of the first and second folds) makes its possible to form means that hold the decorative insert and thus to ensure that the insert is properly positioned against the inside face of the visible strip, regardless of whether the molding is placed in a situation where its visible face is plane or is shaped to have a concave angle or a convex angle.

Thus, with a small range of moldings, the manufacturer can offer a very wide variety of decorative inserts for the user to choose. The inserts can be constituted, for example, by strips of paper or by thin strips of plastic, on which it is much easier to provide decoration in the form of drawings and of given colors than it is on moldings of the type disclosed in French patent No. 2 700 568.

Advantageously, the first link strip and/or the strip of the closure element is connected to the corresponding side portion by a local zone of reduced thickness forming a hinge.

This hinge makes it possible to open the housing for the decoration, at least in part, so as to facilitate inserting the decorative insert into the molding.

It is extremely advantageous to provide two hinges, respectively connecting the first link strip and the strip of the closure element to the side portions of the visible strip, thereby making it possible to open both folds together, thereby making it even easier to position the decorative insert. It then suffices to press it against the inside face of the visible strip before folding down the first link strip and the strip of the closure element against the rear face of the insert in order to hold it in place against said inside face.

It should also be observed that these hinges can be useful during manufacture of the molding. The first link strip and the strip of the closure element normally extend a very small distance (about 1 mm to 3 mm) away from the side portions of the visible strip (the folds are almost flattened). If the molding is extruded while it is in this "normal" position, and if this distance is indeed very small, then there is a risk that the folds will tend to stick together before the structure of the molding has finally stabilized and cooled down. By having hinges present, it is possible to extrude the molding in a situation where it is "open", i.e. in which the link strip and the strip of the closure element are further away from the side portions of the visible strip than they will be in their "normal" in-use position.

The invention can be embodied in two preferred variants. Thus, in the first variant, the closure element comprises a second link strip, a second support strip, and a second spacer flank, the second support strip being designed to be fixed on the support structure, the second spacer flank extending substantially perpendicularly relative to the second side portion in a region of the device which is situated between said second side portion and the second support strip. The second support strip extends between the free margin of the second side portion of the visible strip and the margin of the second spacer flank which is adjacent to said second side portion, and, once the molding has been put into place, the second fold extends over the second support strip in such a manner as to define a second side housing suitable for receiving the side margin of an element such as a panel for covering the support structure.

The device of this first variant is particularly intended for providing the transition between two covering panels. Both panels may be fixed on the same plane formed by the support structure or the two panels may be fixed on two portions of the support structure that are at an angle, which may be a concave angle or a convex angle.

Thus, the visible strip is advantageously suitable for being folded at a fold line extending longitudinally in a middle region of said visible strip.

The fold line defines a zone of small size about which the molding can be folded so as to make its visible face match an angle that is convex or concave. Advantageously, the fold line is formed by a zone of locally reduced thickness in the visible face of the molding, which reduction in thickness should nevertheless not be visible from said visible face.

Advantageously, the device includes means for holding the fold stably in a position in which the visible strip is shaped to form a convex angle.

This disposition makes it easier to fix and hold the molding in place on its support structure, in particular on the convex angles of a wall.

In a particularly advantageous configuration, the two side portions of the visible strip and the two link strips are of substantially the same length.

In this configuration, the decorative insert can be held effectively over the entire width of the overhangs of the visible strip relative to the support strips of the molding (which width corresponds to the width of the first and second folds). When the side margins of elements such as panels covering the support structure are inserted under the overhang zones, they tend to urge the link strips further towards the side portions of the visible strip (i.e. to close up the first and second folds), thereby providing a clamping effect, or at least a jamming effect, on the side margin portions of the decorative insert, thereby further improving the way it is held in place.

In the second variant, once the device has been put into place on the support structure, the second side portion of the visible strip is bent relative to the first side portion about a fold line which extends longitudinally in a middle region of said visible strip in such a manner as to form a convex angle with said first side portion; the first support strip has an "inside" margin which, once the device is in place on the support structure, extends from the free margin of the first side portion of the visible strip towards said bend line at least substantially as far as the bend line; the closure element is formed by a closure strip which, in the convex angle configuration and once the device has been put into place on the support structure, is situated in the vicinity of the first spacer flank; the position of the bend line is such that once the molding has been put into place on the support structure, the width of the portion of the visible strip which is bent relative to the first side portion of said visible strip is substantially equal to the distance between the support structure and the first side portion of the visible strip.

In this second variant, the device of the invention is intended more particularly for lining the visible edges of covering panels.

Advantageously, the closure strip is suitable for pivoting about the free margin of the second side portion of the visible strip, and the device includes means for locking the closure strip in its position in which it forms the second fold with said second side portion.

These locking means also make it possible to hold the visible strip in its folded position in a convex angle, and thus to stabilize this position.

BRIEF DESCRIPTION OF THE DRAWINGS

The invention will be well understood and its advantages will appear more clearly on reading the following detailed description of embodiments given as non-limiting examples. The description refers to the accompanying drawings, in which:

FIG. 4 is a cross-section view extended in perspective of a device constituting a second variant of the invention; and FIG. 5 is a section through a portion of the FIG. 4 device prior to mounting.

MORE DETAILED DESCRIPTION

The molding device is of a section that is constant over its entire length. The side dimensions of the various elements of the device are measured below transversely relative to the length of the device. In addition, the adjective "side" is used to designate elements or portions of elements which are to be found laterally relative to the section of the molding.

Figure 1:
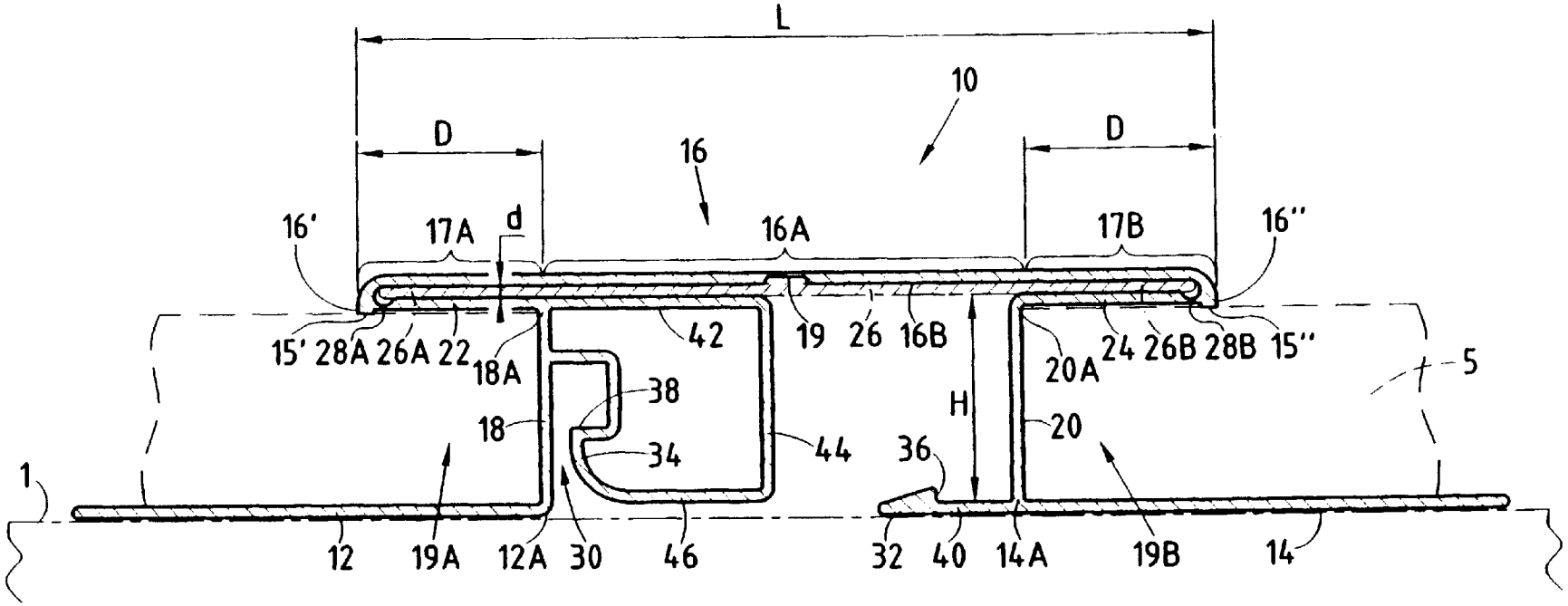
FIG. 1 is a cross-section view of a molding device constituting a first variant of the invention.
Figure 2:
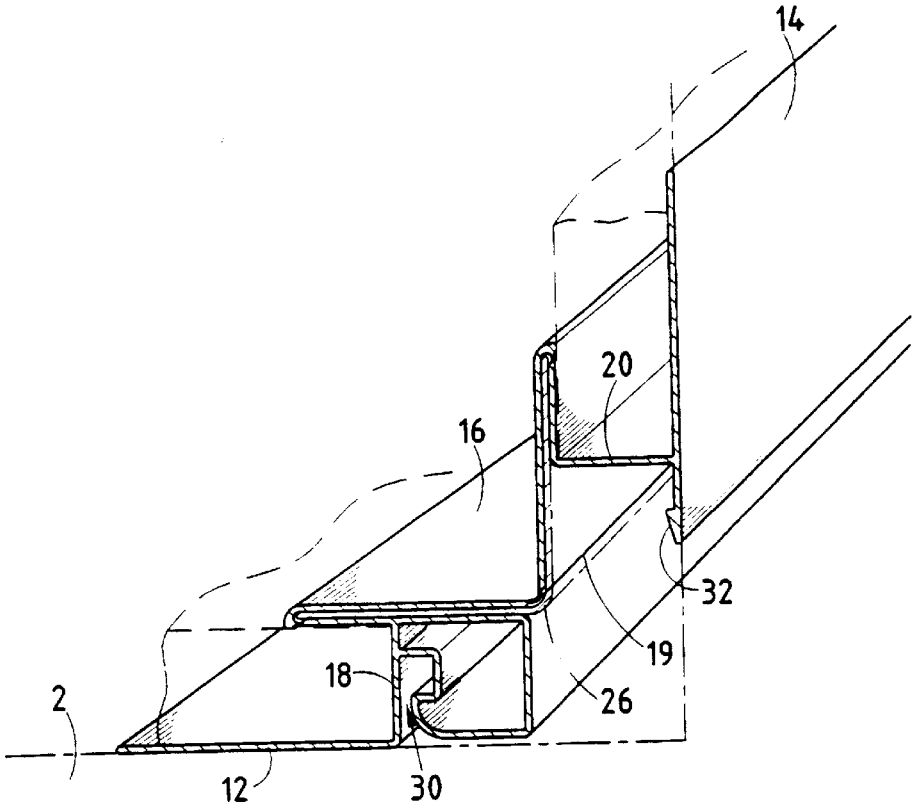
FIGS. 2 and 3 are two cross-section views extended in perspective showing the FIG. 1 device where the molding is shaped respectively to present a concave angle and a convex angle.
Figure 3:
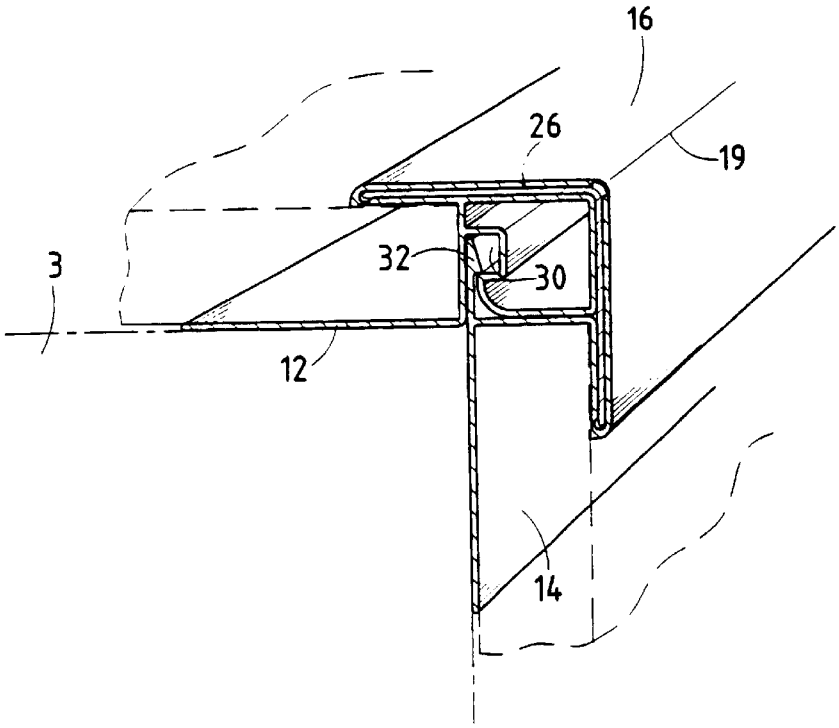

The molding shown in the drawings is an extrusion of transparent plastics material, e.g. clear PVC, and it may be glossy or mat in appearance depending on the composition of the chosen material. In FIGS. 1 to 3, the device is made in the form of a molding that is extruded as a single piece.

However, in FIGS. 4 and 5, the device is made up of two component moldings each constituted by a different piece. Nevertheless, it would also be possible to extrude these two pieces together with them initially being connected together via a breakable web.

In FIG. 1, it can be seen that the molding 10 comprises first and second support strips referenced 12 and 14 respectively which are designed to be fixed to a support structure 1 such as a wall or a ceiling. Any type of fixing means could be envisaged, for example staples, screws (possibly self-drilling screws if holes are not formed in the support strips before the molding is laid), or indeed adhesive.

The molding also has a strip 16 which is visible when it is in place, and first and second spacer flanks given respective references 18 and 20 which are of the same height H and which extend towards the visible strip from respective inside margins 12A and 14A of the support strips to respective outside margins 18A and 20A of said spacer flanks.

The visible strip 16 has a central portion 16A on either side of which there extend two side portions respectively referenced 17A and 17B which are disposed to overhang relative to the two support strips 12 and 14. Specifically, the side portions 17A and 17B cover the support strips 12 and 14 over a width D measured from the inside margins of said strips.

Thus, as shown in dashed lines, the side margins of elements such as covering panels 5 can be inserted in side housings 17A and 17B formed between the side portions 17A and 17B and the support strips. The margins of the panels come into abutment against the outside faces of the spacer flanks.

The margins 18A and 20A of the spacer flanks (those remote from the support strips) are connected to the respective free side margins 16' and 16" of the visible strip via respective link strips 22 and 24. It can be seen that when the molding is put into place in the manner shown in FIG. 1, the link strips extend parallel to the side portions of the visible strip, each link strip 22 or 24 being located at a small distance (about 1 mm to 3 mm) from the corresponding side portion 17A or 17B, respectively. Thus, the assembly formed by the first side portion 17A and by the first link strip 22 forms a first fold, while the assembly formed by the second side portion 17B and by the second link strip 24 forms a second fold.

The margins 16' and 16" are provided with respective heels 15' and 15" which project rearwards a little way (i.e. towards the support strips) beyond the rear faces of the link strips 22 and 24 to press against the visible faces of the panels 5.

In FIG. 1, a decorative insert 26 is shown diagrammatically in the form of a strip which is disposed inside the molding, such that it comes into contact with the inside face 16B of the visible strip 16 of the molding. The housing for the decoration is formed beneath the visible face of the molding, said housing extending over substantially the entire width of said visible face, between the first and second folds. Adjacent to the first fold, the housing for decoration is closed by the first link strip, with the first spacer flank and the first support strip, while adjacent to the second fold, the housing is closed by a closure element comprising the second link strip, the second spacer flank, and the second support strip.

The width of the decorative insert is such that its side margins come practically into contact with the inside faces of the free margins 16' and 16" of the visible strip inside the first and second folds 17A & 22 and 17B & 24. Thus, when the molding is in place, the decoration provided by the insert extends over the entire width of its visible face. It can be seen in FIG. 1 that the side margin portions 26A and 26B of the insert are held between the facing faces of the two elements of each of the folds 17A & 22 and 17B & 24. These folds, formed by the link strips and the side portions of the visible face thus act as holding means and, because of the small distance d between their inside facing faces, they can hold the side margin portions of the insert captive, and can even clamp them between their facing faces.

The link strips 22 and 24 are connected to the corresponding side portions 17A and 17B by zones of locally reduced thickness which form hinges 28A and 28B that extend along the length of the molding. In these zones, the thickness of the plastics material is, for example, less than half the ordinary thickness of the link strips.

The visible strip 16 can be folded about a fold line 19 which extends longitudinally in a middle region of its central portion 16A. As can be seen more clearly in FIG. 1, this fold line is formed by a zone of locally reduced thickness in the visible strip. In the advantageous example shown, the reduced thickness is created by a longitudinal indentation formed in the inside face 16B of the visible strip. In this zone, the thickness of the strip is, for example, less than the half the normal thickness of the visible strip 16. The width of the zone of reduced thickness is relatively small, e.g. 2 mm to 5 mm.

In FIG. 2, the visible face of the molding is shaped to form a concave angle, and the support strips 12 and 14 may be fixed to support structures such as walls 2 that form a concave angle. The angle is not necessarily a right angle insofar as the flexibility given by the fold line makes it possible to match the molding to angles that are open to different extents.

FIG. 3 shows the molding folded in such a manner that its visible strip forms a convex or projecting angle, the support strips 12 and 14 being fixed to support structures such as walls 3 forming a projecting angle. The flexibility given by the fold line makes it possible to match the molding to projecting angles of different sizes.

Nevertheless, the molding advantageously includes means for holding it in a stable folded position where the visible strip is shaped to form a convex angle. Insofar as the convex angles formed by the corners of walls are generally at 90° in most houses, it is preferable for this stable fold position to be selected to correspond to a right angle. Such holding means are advantageous in particular insofar as they enable the mechanical strength of the molding to be reinforced when it is in its convex angle configuration, which configuration is used for fitting to wall regions that are the most subject to various forms of wear and tear (being rubbed against by people moving about in the premises fitted with the molding, various collisions, etc.).

These holding means comprise a female locking profile 30 secured to the first spacer flank 18 and which extends beneath the central portion 16A of the visible strip, at least substantially as far as the fold line 19 from the side of the flank 18 going away from the link strip 22. They also comprise a male locking profile 32 secured to the second spacer flank 20 and extending at least substantially as far as the fold line 19 from the other side of the flank 20 going away from the link strip 24. As can be seen in FIG. 3, the male and female locking profiles 32 and 30 can co-operate to hold the molding in its stable folded position in which the visible strip is shaped to form a convex angle that substantially defines a right angle.

The female profile forms a housing in which the male locking profile can snap-fasten. To this end, a wall 34 of the housing is deformable elastically to a small extent and the male locking profile has a snap-fastening projection 39 which enables the male profile to be retained in its locked position by co-operating like a hook with a retaining surface 38 formed on the wall 34. In the example shown, the male locking profile is made by extra thickness formed on the free edge of a strip 40 which extends the support strip 14 from the side of the spacer flank 20 going away from said strip 14.

To further contribute to holding the insert 26 in place against the inside face 16B of the visible strip 16 of the molding, the molding advantageously has an extension strip 42 which extends one of the first and second link strips, at least substantially as far as the fold line of the visible strip. Thus, in the region of the extension strip, the insert can be held captive or clamped not only between the link strip fitted with said extension strip and the corresponding side portion, but also between the extension strip itself and the region of the central portion 16A of the visible strip that is situated facing the extension strip.

Advantageously, this extension strip is secured to one of the male and female locking profiles 30 and 32, and the profile in question further includes a spacer web 44 that is substantially parallel to the spacer flank to which the profile is secured.

In the example shown, the extension strip 42 is secured to the first spacer flank 18 and the spacer web 44 extends substantially at right angles relative to said extension strip, naturally going away from the visible strip 16. In the example shown, the female locking profile has an outline that is closed on the spacer flank 18. As can be seen in FIG. 3, in the convex angle configuration, the male profile is engaged in the female profile 30 and the wall 46 of the female profile which connects the spacer web 44 to the housing in which the male profile is received comes into abutment against the spacer flank 20. The extension strip 22 and the spacer web 44 then extend respectively facing two halves of the central portion 16A of the visible strip 16 of the molding which are to be found on either side of the fold line. Thus, the decorative insert 26 is held over its entire width.

As can be seen in the figures, the two side portions 17A and 17B of the visible strip 16 and the two link strips 22 and 24 are of substantially the same length. The spacer flanks 18 and 20 form a right angle with the support strips 12 and 14 to which they are respectively attached.

In the "flat" configuration of the molding shown in FIG. 1, the support strips 12 and 14 are situated in a common plane and they extend parallel to the link strips 22 and 24, and also parallel to the visible strip 16. The spacer flanks 18 and 20 are of the same height and they extend perpendicularly both to the visible strip 16 and to the support strips 12 and 14.

The two side portions 17A and 17B of the visible strip 16 are of substantially the same width D, and this width advantageously lies in the range one-fifth to one-third the total width L of the visible strip 16. Furthermore, if the side portions of the visible strip are of the same width as the link strips, then it is ensured that the decorative insert 26 is imprisoned so as to be held in place over sufficient width. Depending on the dimensions of the molding, the widths L and D can for example be about 4 cm to 10 cm and 1 cm to 3 cm, respectively.

FIG. 4 shows a molding device 110 mounted on a support structure such as a wall 4. In the example shown, this device comprises two distinct component moldings: a first molding 105 which comprises a support strip 112 designed to be fixed on the wall; and a second molding 106 which comprises a visible strip 116 designed to be visible when the device is fixed on the wall. The molding 106 is transparent while the molding 105 need not be. The visible strip 116 comprises first and second side portions 117A and 117B. To keep the visible strip 116 at a distance from the support strip 112, the device has spacer means comprising a spacer flank 118 fitted to the second component molding 106. The side margin of the first side portion 117A is connected to the margin 118 of the spacer flank by a link strip 122. As can be seen in FIG. 4, the assembly constituted by the first side portion 117A and by said link strip forms a first fold. The second component molding 106 further comprises a closure strip 124 connected to the free margin of the second side portion 117B. As can be seen in FIG. 4, this second side portion and the closure strip form a second fold. Thus, a housing for decoration is formed inside the second component molding 106 beneath the visible strip 116 thereof, which housing can receive a decorative insert 126 whose side margins are held in the two above-mentioned folds, and which extends over substantially the entire width of this visible face of the molding. Adjacent to the first fold, the housing for decoration is closed by the link strip 122, together with the spacer flank 118 and the support strip 112, while adjacent to the second fold, this housing is closed by the closure element formed by the closure strip 124.

The device shown in FIG. 4 is particularly intended to cover the edge of a decorative panel. Consequently, the second side portion 117B of the visible strip is bent relative to the first side portion about a bend line 119 which extends longitudinally in a middle region of the visible strip. This strip is thus shaped to form a convex angle, and it can be seen that the width L1 of the entire portion of the visible strip 116 which is bent relative to the first side portion 117A thereof about the line 119 is substantially equal to the distance D1 between the visible face of the first side portion 117A and the support structure 4, which distance is measured substantially perpendicularly to said structure. Thus, when bent to form a projecting angle, the second side portion 117B completely masks the thickness of the edge of the covering panel inserted in the side housing 119A and also masks all of the "inside" elements of the molding device. It can be seen that in this configuration of FIG. 4, the closure strip 124 is situated in the vicinity of the spacer flank 118.

The first component molding 105 has assembly means suitable for co-operating with the first spacer flank 118 both to secure the two component moldings together and to hold the assembly formed by the first fold 117A & 122 at a distance from the support strip 112.

In the example shown, these assembly means comprise a housing 120 which is formed between two assembly flanks (120A and 120B respectively) which extend substantially perpendicularly relative to the support strip 112. The spacer flank 118 is engaged in this housing 120. It can be seen that in this convex angle configuration of FIG. 4, the assembly forming the first fold 117B & 124 is folded against the assembly flank 120B that is the closest to the bend line 119. The outside face of the closure strip 124 is practically in contact with said assembly flank 120B.

The device has means for retaining the flank 118 inside the housing 120. Thus, as can be seen in FIG. 4, the flank 118 can be provided with longitudinal ribs 121A which can be engaged in grooves 121B formed in the inside faces of the assembly flanks 120A and 120B.

As can also be seen in FIG. 4, the free margin of the first side portion 117A of the visible face 116 is fitted with a heel 115'.

In addition, a first hinge 128A is formed by a zone of reduced thickness at the junction between the first side portion 117A and the link strip 122. It can also be seen that a second hinge 128B is formed by a zone of reduced thickness at the junction between the second side portion 117B and the closure strip 120.

Similarly, the above-mentioned bend line 119 can be a fold line made by a zone of reduced thickness.

Once the molding device has been put into place on the support structure, it can be seen that the housing which contains the insert 126 is implemented in the form of a continuous slot whose cross-section is bent in shape. To facilitate inserting the insert in the housing for decoration, advantage may advantageously be taken of the hinges. Furthermore, FIG. 5 shows the configuration that the second component molding 106 can take up while it is being manufactured by extrusion. To facilitate stabilizing the structure of this molding, the hinges are used to space the link strip 122 apart from the first portion of the visible strip 117A. Similarly, as shown by dashed lines, the closure strip 124 can be spaced apart from the second side portion 117B. As mentioned above with reference to the first variant, since it is possible to move the link strip away from the visible strip 124, it is also possible to facilitate insertion of the decorative insert into its housing.

When the closure strip 124 is indeed capable of pivoting relative to the second side portion 117B, the device advantageously includes means for locking said closure strip in its position in which it forms the second fold with the second side portion.

Thus, as can be seen in FIGS. 4 and 5, the device advantageously includes a snap-fastening member 130 which is secured to the first link strip 122 and which is situated on the other side thereof relative to the spacer flank 118. The free margin of the closure strip 124 is suitable for snap-fastening with said snap-fastening member. It can be seen the member 130 includes, for example, a step 131 in which the free margin 125 of the strip 124 can be received. A rib 133 disposed on the edge of the step 131 can further increase the snap-fastening effect. To provide good snap-fastening, abutment or position wedging means can be provided for the strip 124 constituted by a rib 126, for example.

What is claimed is:

1. A finishing profile device or molding comprising at least a first support strip designed to be fixed on a support structure and a visible strip designed to be visible when the molding is in place on said support structure, said visible strip comprising first and second side portions of strip shapes, at least the first side portion extending over the first support strip being held spaced apart therefrom by first spacer means once the molding has been put into place on said support structure so as to define at least a first side housing suitable for receiving the side margin of an element such as a panel for covering the support structure, wherein at least the visible strip is made of transparent plastics material, wherein the first spacer means comprise a first spacer flank which extends substantially perpendicularly relative to said first side portion in a region of the device which is situated between said side portion and the first support strip, wherein the device has a first link strip and a closure element, said first link strip extending between the free margin of the first side portion of the visible strip and the margin of the first spacer flank which is adjacent to said first side portion, while the closure element has a strip which is connected to the free margin of the second side portion of the visible strip, wherein once the device has been put into place on the support structure, the first side portion and the first link strip form two substantially parallel portions of a first fold extending over the first support strip, while the second side portion and the strip of the closure element form two substantially parallel portions of a second fold, wherein the device has a housing for decoration formed beneath the visible face and extending over substantially the entire width thereof between the first and second folds, said housing for decoration being suitable for containing a decorative insert in the form of a strip such that the side margin portions of said insert are respectively inserted in the first and second folds, and wherein the first and second folds form respective first and second holding means suitable for holding said side margin portions of such a decorative insert in place.

2. A device according to claim 1, wherein the first link strip is connected to the first side portion via a zone of locally reduced thickness forming a hinge.

3. A device according to claim 1, wherein the closure element strip is connected to the second side portion via a zone of locally reduced thickness forming a hinge.

4. A device according to claim 1, wherein the closure element comprises a second link strip, a second support strip, and a second spacer flank, the second support strip being designed to be fixed on the support structure, the second spacer flank extending substantially perpendicularly relative to the second side portion in a region of the device which is situated between said second side portion and the second support strip, wherein the second support strip extends between the free margin of the second side portion of the visible strip and the margin of the second spacer flank which is adjacent to said second side portion, and wherein, once the molding has been put into place, the second fold extends over the second support strip in such a manner as to define a second side housing suitable for receiving the side margin of an element such as a panel for covering the support structure.

5. A device according to claim 4, wherein the visible strip is suitable for being folded at a fold line extending longitudinally in a middle region of said visible strip.

6. A device according to claim 5, including means for holding it in a stable folded position in which the visible strip is shaped to form a projecting angle.

7. A device according to claim 6, wherein the first spacer flank is secured to a female locking profile that extends beneath the visible strip at least substantially as far as the fold line of said visible strip, while the second spacer flank is secured to a male locking profile which extends beneath the visible strip at least substantially as far as the fold line of said visible strip, and wherein said male and female locking profiles are suitable for co-operating to hold the molding in a stable folded position in which the visible strip is shaped as a convex angle defining substantially a right angle.

8. A device according to claim 5, including an extension strip which extends in line with one of the first and second link strips at least substantially as far as the fold line of the visible strip.

9. A device according to claim 7, including an extension strip which extends in line with one of the first and second link strips at least substantially as far as the fold line of the visible strip, wherein the extension strip is secured to one of the male and female locking profiles, and wherein said shape further includes a spacer web substantially parallel to the spacer flank to which said profile is secured.

10. A device according to claim 1, made as a one-piece extrusion.

11. A device according to claim 1, wherein, once the device has been put into place on the support structure, the second side portion of the visible strip is bent relative to the first side portion about a fold line which extends longitudinally in a middle region of said visible strip in such a manner as to form a convex angle with said first side portion, wherein the first support strip has a "inside" margin which, once the device is in place on the support structure, extends at least substantially as far as the bend line in the direction going from the free margin of the first side portion of the visible strip towards said bend line, wherein the closure element is formed by a closure strip which, in the convex angle configuration and once the device has been put into place on the support structure, is situated in the vicinity of the first spacer flank, and wherein the position of the bend line is such that once the molding has been put into place on the support structure, the width of the portion of the visible strip which is bent relative to the first side portion of said visible strip is substantially equal to the distance between the support structure and the first side portion of the visible strip.

12. A device according to claim 11, wherein the support strip and the visible strip form parts respectively of a first and of a second molding, wherein the first molding has assembly means suitable for co-operating with the first spacer flank to hold the two moldings together and to hold the first side portion of said visible strip away from the first support strip.

13. A device according to claim 12, wherein the assembly means comprise a housing formed between two assembly flanks extending substantially perpendicularly to the first support strip, said housing being suitable for receiving the first spacer flank, and wherein the device includes means for retaining said first spacer flank in said housing.

14. A device according to claim 11, wherein the closure strip is suitable for pivoting about the free margin of the second side portion of the visible strip, and wherein the device includes means for locking the closure strip in its position in which it forms the second fold with said second side portion.

15. A device according to claim 14, including a snap-fastening member situated on the other side of the first link strip relative to the first spacer flank, and wherein the free margin of the closure strip is suitable for co-operating by snap-fastening with said snap-fastening member.

* * * * *